US006127774A

United States Patent [19]

Janning

[11] Patent Number: 6,127,774

[45] Date of Patent: Oct. 3, 2000

[54] FIELD EMISSION DISPLAY DEVICES

[75] Inventor: John L. Janning, Dayton, Ohio

[73] Assignee: St. Clair Intellectual Property Consultants, Inc., Grosse Pointe, Mich.

[21] Appl. No.: 09/311,501

[22] Filed: May 13, 1999

Related U.S. Application Data

[62] Division of application No. 08/852,228, May 6, 1997, Pat. No. 5,982,082.

[51] Int. Cl.[7] ..... H01J 19/24

[52] U.S. Cl. ..... 313/309; 313/336; 313/351; 313/495; 313/497; 313/107

[58] Field of Search ..... 313/336, 309, 313/351, 495, 496, 497, 103 C, 105 C, 103 R, 105 R, 106, 107

[56] References Cited

U.S. PATENT DOCUMENTS

| | | | |
|---|---|---|---|
| 2,992,349 | 7/1961 | Cusano | 313/309 |
| 3,560,784 | 2/1971 | Steel | 313/495 |
| 4,381,474 | 4/1983 | Cusano | 313/463 |
| 4,540,914 | 9/1985 | Maple | 313/466 |
| 4,857,161 | 8/1989 | Borel et al. | 313/309 |
| 5,229,331 | 7/1993 | Doan et al. | 313/309 |
| 5,378,963 | 1/1995 | Ikeda | 313/495 |
| 5,384,509 | 1/1995 | Kane et al. | 313/309 |
| 5,438,240 | 8/1995 | Cathey et al. | 313/336 |
| 5,461,280 | 10/1995 | Kane | 313/336 |
| 5,473,218 | 12/1995 | Moyer | 313/309 |
| 5,473,219 | 12/1995 | Ikeda | 313/497 |
| 5,509,839 | 4/1996 | Liu | 313/496 |
| 5,534,749 | 7/1996 | Ohoshi et al. | 313/497 |
| 5,646,479 | 7/1997 | Troxell | 313/495 |
| 5,656,887 | 8/1997 | Voshell | 313/496 |
| 5,821,685 | 10/1998 | Peterson | 313/309 |

OTHER PUBLICATIONS

Dr. Jacques I. Pankove, "Electroluminescence", Spring–Verlag Berlin Heidelberg New York 1977, pp. 197–210.

*Primary Examiner*—Nimeshkumar D. Patel
*Assistant Examiner*—Joseph Williams
*Attorney, Agent, or Firm*—Harness, Dickey & Pierce,P.L.C.

[57] ABSTRACT

Cathodoluminescent field emission display devices feature phosphor biasing, amplification material layers for secondary electron emissions, oxide secondary emission enhancement layers, and ion barrier layers of silicon nitride, to provide high-efficiency, high-brightness field emission displays with improved operating characteristics and durability. The amplification materials include copper-barium, copper-beryllium, gold-barium, gold-calcium, silver-magnesium and tungsten-barium-gold, and other high amplification factor materials fashioned to produce high-level secondary electron emissions within a field emission display device. For enhanced secondary electron emissions, an amplification material layer can be coated with a near monomolecular film consisting essentially of an oxide of barium, beryllium, calcium, magnesium or strontium. Use of a high amplification factor film as a phosphor biasing electrode, and variability of the phosphor biasing potential to achieve brightness or gray scale control are further described in the disclosure.

6 Claims, 1 Drawing Sheet

FIELD EMISSION DISPLAY DEVICES

This is a division of U.S. patent application Ser. No. 08/852,228, filed May 6, 1997 now U.S. Pat. No. 5,982,082.

This invention relates to electronic field emission display devices, such as matrix-addressed monochrome and full color flat panel displays in which light is produced by using cold-cathode electron field emissions to excite cathodoluminescenct material. Such devices use electronic fields to induce electron emissions, as opposed to elevated temperatures or thermionic cathodes as used in cathode ray tubes.

GROUND OF THE INVENTION

Cathode ray tube (CRT) designs have been the predominant display technology, to date, for purposes such as home television and desktop computing applications. CRTs have drawbacks such as excessive bulk and weight, fragility, power and voltage requirements, electromagnetic emissions, the need for implosion and X-ray protection, analog device characteristics, and an unsupported vacuum envelope that limits screen size. However, for many applications, including the two just mentioned, CRTs have present advantages in terms of superior color resolution, contrast and brightness, wide viewing angles, fast response times, and low cost of manufacturing.

To address the inherent drawbacks of CRTs, such as lack of portability, alternative flat panel display design technologies have been developed. These include liquid crystal displays (LCDs), both passive and active matrix, electroluminescent displays (ELDs), plasma display panels (PDPs), and vacuum fluorescent displays (VFDs). While such flat panel displays have inherently superior packaging, the CRT still has optical characteristics that are superior to most observers. Each of these flat panel display technologies has its unique set of advantages and disadvantages, as will be briefly described.

The passive matrix liquid crystal display (PM-LCD) was one of the first commercially viable flat panel technologies, and is characterized by a low manufacturing cost and good x-y addressability. Essentially, the PM-LCD is a spatially addressable light filter that selectively polarizes light to provide a viewable image. The light source may be reflected ambient light, which results in low brightness and poor color control, or back lighting can be used, resulting in higher manufacturing costs, added bulk, and higher power consumption. PM-LCDs generally have comparatively slow response times, narrow viewing angles, a restricted dynamic range for color and gray scales, and sensitivity to pressure and ambient temperatures. Another issue is operating efficiency, given that at least half of the source light is generally lost in the basic polarization process, even before any filtering takes place. When back lighting is provided, the display continuously uses power at the maximum rate while the display is on.

Active matrix liquid crystal displays (AM-LCDs) are currently the technology of choice for portable computing applications. AM-LCDs are characterized by having one or more transistors at each of the display's pixel locations to increase the dynamic range of color and gray scales at each addressable point, and to provide for faster response times and refresh rates. Otherwise, AM-LCDs generally have the same disadvantages as PM-LCDs. In addition, if any AM-LCD transistors fail, the associated display pixels become inoperative. Particularly in the case of larger high resolution AM-LCDs, yield problems contribute to a very high manufacturing cost.

AM-LCDs are currently in widespread use in laptop computers and camcorder and camera displays, not because of superior technology, but because alternative low cost, efficient and bright flat panel displays are not yet available. The back lighted color AM-LCD is only about 3 to 5% efficient. The real niche for LCDs lies in watches, calculators and reflective displays. It is by no means a low cost and efficient display when it comes to high brightness full color applications.

Electroluminescent displays (ELDs) differ from LCDs in that they are not light filters. Instead, they create light from the excitation of phosphor dots using an electric field typically provided in the form of an applied AC voltage. An ELD generally consists of a thin-film electroluminescent phosphor layer sandwiched between transparent dielectric layers and a matrix of row and column electrodes on a glass substrate. The voltage is applied across an addressed phosphor dot until the phosphor "breaks down" electrically and becomes conductive. The resulting "hot" electrons resulting from this breakdown current excite the phosphor into emitting light.

ELDs are well suited for military applications since they generally provide good brightness and contrast, a very wide viewing angle, and a low sensitivity to shock and ambient temperature variations. Drawbacks are that ELDs are highly capacitive, which limits response times and refresh rates, and that obtaining a high dynamic range in brightness and gray scales is fundamentally difficult. ELDs are also not very efficient, particularly in the blue light region, which requires rather high energy "hot" electrons for light emissions. In an ELD, electron energies can be controlled only by controlling the current that flows after the phosphor is excited. A full color ELD having adequate brightness would require a tailoring of electron energy distributions to match the different phosphor excitation states that exist, which is a concept that remains to be demonstrated.

Plasma display panels (PDPs) create light through the excitation of a gaseous medium such as neon sandwiched between two plates patterned with conductors for x-y addressability. As with ELDs, the only way to control excitation energies is by controlling the current that flows after the excitation medium breakdown. DC as well as AC voltages can be used to drive the displays, although AC driven PDPs exhibit better properties. The emitted light can be viewed directly, as is the case with the red-orange PDP family. If significant UV is emitted, it can be used to excite phosphors for a full color display in which a phosphor pattern is applied to the surface of one of the encapsulating plates. Because there is nothing to upwardly limit the size of a PDP, the technology is seen as promising for large screen television or HDTV applications. Drawbacks are that the minimum pixel size is limited in a PDP, given the minimum volume requirement of gas needed for sufficient brightness, and that the spatial resolution is limited based on the pixels being three-dimensional and their light output being omnidirectional. A limited dynamic range and "cross talk" between neighboring pixels are associated issues.

Vacuum fluorescent displays (VFDs), like CRTs, use cathodoluminescence, vacuum phosphors, and thermionic cathodes. Unlike CRTs, to emit electrons a VFD cathode comprises a series of hot wires, in effect a virtual large area cathode, as opposed to the single electron gun used in a CRT. Emitted electrons can be accelerated through, or repelled from, a series of x and y addressable grids stacked one on top of the other to create a three dimensional addressing scheme. Character-based VFDs are very inexpensive and widely used in radios, microwave ovens, and automotive dashboard instrumentation. These displays typically use low voltage ZnO phosphors that have significant output and acceptable efficiency using 10 volt excitation.

A drawback to such VFDs is that low voltage phosphors are under development but do not currently exist to provide the spectrum required for a full color display. The color vacuum phosphors developed for the high-voltage CRT market are sulfur based. When electrons strike these sulfur based phosphors, a small quantity of the phosphor decomposes, shortening the phosphor lifetimes and creating sulfur bearing gases that can poison the thermionic cathodes used in a VFD. Further, the VFD thermionic cathodes generally have emission current densities that are not sufficient for use in high brightness flat panel displays with high voltage phosphors. Another and more general drawback is that the entire electron source must be left on all the time while the display is activated, resulting in low power efficiencies particularly in large area VFDs.

Against this background, field emission displays (FEDs) potentially offer great promise as an alternative flat panel technology, with advantages which would include low cost of manufacturing as well as the superior optical characteristics generally associated with the traditional CRT technology. Like CRTs, FEDs are phosphor based and rely on cathodoluminescence as a principle of operation. High voltage sulfur based phosphors can be used, as well as low voltage phosphors when they become available.

Unlike CRTs, FEDs rely on electric field or voltage induced, rather than temperature induced, emissions to excite the phosphors by electron bombardment. To produce these emissions, FEDs have generally used a multiplicity of x-y addressable cold cathode emitters. There are a variety of designs such as point emitters (also called cone, microtip or "Spindt" emitters), wedge emitters, thin film amorphic diamond emitters or thin film edge emitters, in which requisite electric field can be achieved at lower voltage levels.

Each FED emitter is typically a miniature electron gun of micron dimensions. When a sufficient voltage is applied between the emitter tip or edge and an adjacent extraction gate, electrons quantum mechanically tunnel out of the emitter. The emitters are biased as cathodes within the device and emitted electrons are then accelerated to bombard a phosphor generally applied to an anode surface. Generally, the anode is a transparent electrically conductive layer such as indium tin oxide (ITO) applied to the inside surface of a faceplate, as in a CRT, although other designs have been reported. For example, phosphors have been applied to an insulative substrate adjacent the gate electrodes which form apertures encircling microtip emitter points. Emitted electrons move upwardly through the apertures in an arc type path, over the gate electrodes and back downwardly to strike the adjacent phosphor areas.

FEDs are generally energy efficient since they are electrostatic devices that require no heat or energy when they are off. When they operate, nearly all of the emitted electron energy is dissipated on phosphor bombardment and the creation of emitted unfiltered visible light. Both the number of exciting electrons (the current) and the exciting electron energy (the voltage) can be independently adjusted for maximum power and light output efficiency. FEDs have the further advantage of a highly nonlinear current-voltage field emission characteristic, which permits direct x-y addressability without the need of a transistor at each pixel. Also, each pixel can be operated by its own array of FED emitters activated in parallel to minimize electronic noise and provide redundancy, so that if one emitter fails the pixel still operates satisfactorily. Another advantage of FED structures is their inherently low emitter capacitance, allowing for fast response times and refresh rates. Field emitter arrays are in effect, instantaneous response, high spatial resolution, x-y addressable, area-distributed electron sources unlike those in other flat panel display designs.

While the FED technology holds out many promises, existing designs are not without drawbacks. Present FED designs typically comprise a transparent glass face plate having its inside surface coated with a transparent conductive layer such as an ITO layer that serves as an anode. The anode layer is coated with a phosphor pattern much as within a CRT. An x-y electrically addressable matrix of cold cathode field emitters is generally spaced apart from the phosphors by a large number of minute spacer structures to maintain a uniform gap between the emitter points and the opposing phosphor surfaces. To reduce voltage requirements and allow for a viable mean free path for the emitted electrons, a gettered vacuum is generally provided and maintained within this phosphor/emitter spacing. Typical construction and operating voltages for such devices are on the order of about 100 to 200 $\mu$m for the emitter to phosphor spacing, $10^{-5}$ to $10^{-7}$ Torr for the spacing vacuum environment, 500 to 1500 V for the cathode to anode voltages for high voltage and sulfur based phosphors (~100 V for low voltage phosphors), and 15 to 70 V for the cathode to emitter gate potentials.

Although lower operating voltages are preferred, particularly for portable applications, maximum luminous efficiencies are achieved at higher voltages particularly for the high voltage sulfur based phosphors. Because low voltage electrons do not have sufficient energy to penetrate the aluminum coating generally used behind the phosphor layer to reflect light toward the viewer in a CRT, FEDs typically use unaluminized phosphors. In addition light conversion efficiencies are generally higher in the 10 to 20 kV range used in traditional CRTs.

Use of higher voltage levels in the typical FED constructions gives rise to a special set of problems, however. Given the narrow emitter to phosphor gap and the presence of the spacers, there is a definite potential for electrical arcing especially along the spacer sidewalls. The problem is made worse when the spacers are contaminated by phosphor decomposition and sputtering resulting from normal operation of the device, particularly when the sulfur based phosphors are used.

It has been appreciated that it may be possible in theory to move to higher voltage levels by increasing the phosphor to emitter gap. It has been suggested this may require electron beam focusing, such as by fabricating an electrostatic lens over each pixel emitter matrix, to avoid the kind of pixel to pixel cross talk encountered with VFDs. Another issue is that larger gaps would generally require a higher vacuum, to maintain the mean free paths for the emitted electrons. Further, manufacturing feasibility issues are raised by the spacers, if the spacer heights are to be increased while maintaining the small spacer diameters required for the pixel densities in a high resolution display, or if large area displays are to be realized using the FED technology.

Still another issue with FEDs is the problem of cathode emitter poisoning that can result from decomposition of the phosphors, particularly the sulfur based phosphors, as previously described with respect to VFDs. The problem is only made worse by moving to higher voltage and hence electron energy levels which would tend to increase the decomposition rates of the bombarded phosphors.

While extensive research and development has been devoted to FEDs in recent years, the noted problems essentially remain unsolved. It was against this background that the present invention has been conceived.

OBJECTS OF THE INVENTION

It is accordingly an object of this invention to provide a low cost, high efficiency field emission display having the superior optical characteristics generally associated with the traditional CRT technology, in the form of a digital device with flat panel packaging.

Another object of the invention is to provide a field emission display device, for either monochrome or full color applications, with improved light conversion efficiencies, and with greater cathode to anode voltage level flexibility.

Another object of the invention is to lower the voltage requirements for high brightness cathodoluminescence within a field emission display device with improved light conversion efficiencies.

Another object of the invention is a field emission display device with improved light conversion efficiencies and a smaller emitter to phosphor gap within the device.

Another object of the invention is a field emission display device with improved light conversion efficiencies and a lower working vacuum within the device.

Another object of the invention is a field emission display device with improved light conversion efficiencies and in which requirements for an emitter to phosphor gap or an internal vacuum are either reduced, or altogether eliminated in the case of an all-film emitter/screen device structure.

Another object of the invention is a field emission display device in which improved light conversion efficiencies may be achieved without problems associated with pixel to pixel cross talk or need for special lenses to effect electron beam focusing.

Another object of the invention is a field emission display device in which plating of the anode materials or other materials on or into the phosphors is inhibited, to enhance the lifetime of the phosphors within the device.

Another object of the invention is a field emission display device in which decomposition or sputtering of the phosphors is inhibited, to thereby inhibit contamination of the emitters or any spacer structures within the device.

Another object of the invention is to provide a field emission display device with an improved mechanism for achieving gray scale resolutions within the device.

Still another object of the invention is to advance the use of gold-calcium as an electron emission amplification material, as well as the use of gold-calcium and other amplification materials for use within field emission display devices.

SUMMARY OF THE INVENTION

The invention applies generally to field emission display devices which use cathodoluminescence of a light emitting layer as a principle of operation. In such devices, a field emitter cathode matrix may be opposed by a phosphor-coated, transparent faceplate that serves as an anode and has a positive voltage relative to the emitter array matrix. The devices will typically incorporate a transparent conductive layer such as indium tin oxide (ITO) applied to the inside surface of the faceplate, or between the faceplate and the phosphor coating, to provide the anode electrode for applicable biasing with respect to the cathode-emitters. The phosphor coating may be masked or patterned on the faceplate to provide a matrix of x-y addressable pixels, with addressing provided via a selective cathode-emitter activation. The devices may use high voltage sulfur-based phosphors, or low voltage phosphors may also be used. Smooth deposited phosphor films on the order of about 1200 Angstroms thick are presently preferred for use with this invention, for improved light transmission.

In accordance with one aspect of the invention, the light emitting layer or pattern is electrically biased with respect to the anode, either with a DC or an AC potential, to generally lower the electron energy levels required for high-brightness, cathodoluminescent light emissions. AC biasing is presently preferred for high voltage phosphors (to discharge possible buildup of capacitive charges), and DC biasing is presently preferred for low voltage phosphors. Advantageously, the biasing potential can be adjusted or modulated to provide brightness or gray scale control within the display. A more general advantage is that phosphor biasing permits an FED to realize higher brightness levels. Also, smaller emitter-cathode to phosphor spacings and a lower vacuum than would otherwise be practicable can be used. For example, it may be feasible to use an emitter-cathode to phosphor spacing of less than 100 $\mu$m, an internal working vacuum less than $10^{-5}$ Torr, and an emitter-cathode to anode working potential less than about 500 volts (e.g., for high voltage phosphors), as may be desired. Preferably a biasing electrode will be in the form of a thin conductive film, disposed between the phosphors and the opposed cathode-emitters, applied either on the phosphors directly, or atop intervening film layers as will be described.

In accordance with a further aspect of the invention, amplification materials can be advantageously utilized to further lower the electron energy levels required for high-brightness, cathodoluminescent light emissions. Generally, a high-amplification-factor material layer can be disposed between the opposed cathode-emitters and the phosphors, applied either on the phosphors directly or atop intervening film layers, for producing secondary emissions of electrons when bombarded by primary emissions from the emitters. Preferably, the material used will have a high amplification factor on the order of that associated with copper-beryllium or silver-magnesium. Both of these materials have been used successfully for amplified secondary electron emissions in prior art photo-multiplier tubes and are well suited for use with this invention. Other suitable materials include copper-barium, gold-barium or tungsten-barium-gold, that are well known to have similar high amplification factors. Also, gold-calcium may be a particularly effective amplification material to use. An amplification layer thickness on the order of about 120 Angstroms is presently preferred, for effective amplification as well as transmission of primary emission energies and current for high-brightness display operations. Advantageously, the amplification layer can also serve as the biasing electrode, for purposes of phosphor biasing when implemented.

To achieve enhanced secondary electron emissions within the FED, an amplification layer can be applied over top of an amplification enhancement layer or film consisting essentially of an oxide of barium, beryllium, calcium, magnesium or strontium. Preferably, the amplification enhancement layer will be a near mono-molecular layer of magnesium oxide or beryllium oxide, itself applied either on the phosphors directly or atop intervening film layers.

To inhibit effects of phosphor sputtering or decomposition within the FED device, and to lessen or help eliminate requirements for emitter-cathode to phosphor spacings and a high working vacuum, a barrier layer in the form of a thin film of insulator material may be disposed between the emitter-cathodes and the phosphors. Preferably, this will be a thin silicon nitride layer applied directly on the phosphors, to permit the tunneling of electrons but inhibit the flow of ions or scattering of the phosphor materials within the device when the device is activated. A silicon nitride barrier layer thickness on the order of about 30 to 40 Angstroms is presently preferred. Other dielectric materials such as silicon dioxide, magnesium fluoride or polyamide materials (e.g., Kapton™ polyamide film) may also be used for this thin film barrier layer.

To inhibit ion flow, migration or depositions of anode material on or into the phosphors, a thin film barrier layer of insulator material may be disposed between the anode and the phosphors to thereby enhance the phosphor lifetimes. A silicon nitride barrier layer with a thickness on the order of about 30 to 40 Angstroms is presently preferred for this purpose, to permit electron tunneling but inhibit anode to phosphor plating effects. Other dielectric materials such as silicon dioxide, magnesium fluoride or polyamide materials (e.g., Kapton™ polyamide film) may also be used for this thin film barrier layer. A semiconductor material, such as amorphous or poly silicon, can also be used for this barrier layer.

The above-mentioned and other objects, features and advantages of the invention will become apparent from the further descriptions and the attached drawings.

DETAILED DESCRIPTION OF THE PRESENTLY PREFERRED EMBODIMENTS

Figure 1:
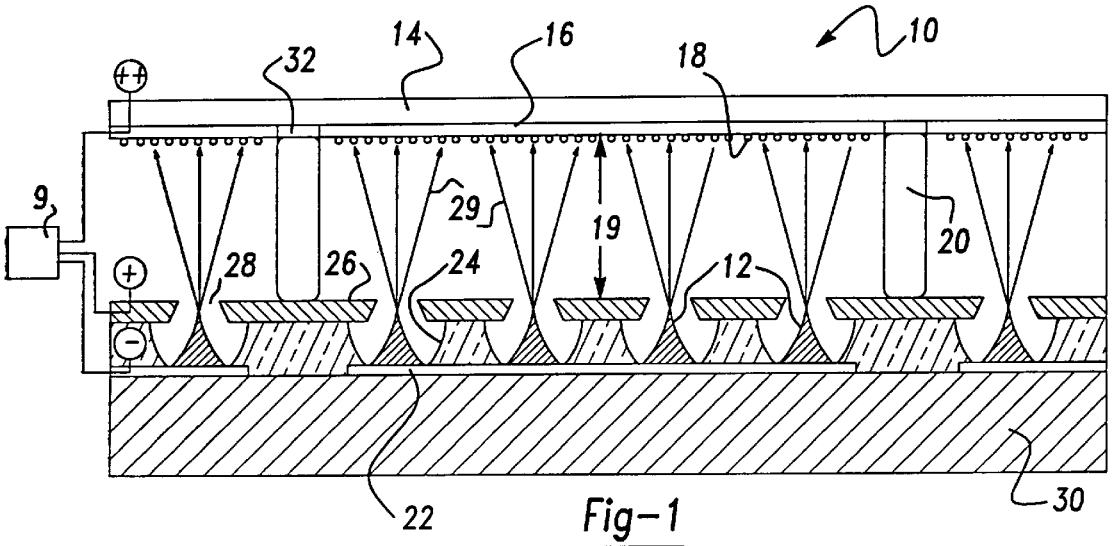
Fig-1 (Prior Art)
FIG. 1 is a cross sectional schematic view of an exemplary field emission display device within the prior art.

FIG. 1 schematically depicts an exemplary field emission display (FED) device 10 found within the prior art. This flat panel display comprises an x-y electrically addressable matrix of cold-cathode microtip or "Spindt" type field emitters 12 opposing a faceplate 14 coated with a transparent conductor layer 16 and a phosphor light emissive layer 18. A distance or gap 19, generally on the order of 100 to 200 $\mu$m, is maintained between the emitters 12 and the phosphors 18 by spacers 20. The volume of space between the emitters 12 and the phosphors 18 is evacuated to provide a vacuum environment with a pressure generally in the range of $10^{-5}$ to $10^{-7}$ Torr. This environment is generally gettered (by means not illustrated) to mitigate against contamination of the internal parts, and to maintain the vacuum.

As illustrated, each emitter 12 has the shape of a cone and is coupled at its base to an addressable emitter electrode conductor strip or layer 22, through which the emitter 12 is biased as a cathode having a negative voltage, via power supply 9, with respect to the conductor 16 which serves as the anode. Adjacent conductor strips 22 are electrically separated by extensions of a dielectric insulator structure 24 that also separates adjacent emitters 12. A conductive electron extraction grid 26 is positively biased as a gate electrode with respect to the emitters 12, and has apertures 28 through which emitted electrons 29 have a path from the emitters 12 to the phosphors 18. The extraction grid 26 can be an addressable strip, orthogonal to the conductors 22, for servicing a row or column of matrix groups of emitters 12. In that case there would typically be a multiplicity of orthogonal extraction grids 26 and conductor strips used within the FED 10. As shown, the extraction grid 26 is spaced and electrically isolated from the conductors 22 by the insulator structure 24. The emitters 12 and the conductors 22 are formed on a substrate or base plate 30.

When the FED 10 is operational, a group of emitters 12 is addressed and activated by application of a gate potential, usually on the order of about 15 to 50 volts, between the associated cathode electrode strip 22 and extraction grid 26. With the resulting primary field emission of electrons from the emitters 12, the emitted electrons are accelerated toward the anode conductor layer 16 to bombard the intervening phosphors 18. The phosphors 18 are induced into cathodoluminescence by the bombarding electrons, emitting light through the faceplate 14 for observation by a viewer. The operational potential between the cathode electrode strip 22 and the anode conductor layer 16 at the faceplate 14 is generally on the order of 500 to 1000 volts for FEDs using high-voltage, sulfur-based phosphors.

As illustrated in FIG. 1, the phosphors 18 may be optionally patterned on the faceplate 14 with conventional black matrix separations 32 to better define dots or discrete pixel areas which may be digitally addressed and illuminated on the FED 10. As shown, each pixel may be serviced by its own matrix or multiplicity of emitters 12 to provide redundancy in the event one or more of the emitters 12 prove inoperative.

By miniaturizing the size of the emitters 12, modest voltages can cause electrons to tunnel out of the cone tips very efficiently, without heat. For this reason, these and operationally similar field emitters are often called "cold cathode" emitters. "Spindt" type emitters 12 are typically sized with cone heights on the order of about 1 $\mu$m, and pitched at about 10 microns or less, allowing packing densities on the order of about $10^6$ emitters per $cm^2$. Apertures 28 are typically sized with diameters on the order of 1 $\mu$m.

The illustrated field emitter structure, comprising the emitters 12, the conductor strips 22, the insulator structure 24, and the extraction grid 26, can generally be made at low cost using semiconductor micro-fabrication technology. For example, the emitters 12 can be formed on the conductor strips 22 on a silicon substrate 30 and overlaid by sequential depositions of a layer of silicon dioxide and a conductive metal gate film for the insulator structure 24 and the extraction grid 26. Resulting raised areas over the emitters 12 can be removed by polishing, and the silicon dioxide dielectric immediately surrounding the emitters 12 can be removed by wet chemical etching to define self-aligned apertures 28, as is well known.

FIG. 1 is not drawn to scale, as a typical FED of the type illustrated would generally have 100 or more of the emitters 12 for servicing of each pixel area on the display.

Figure 2:
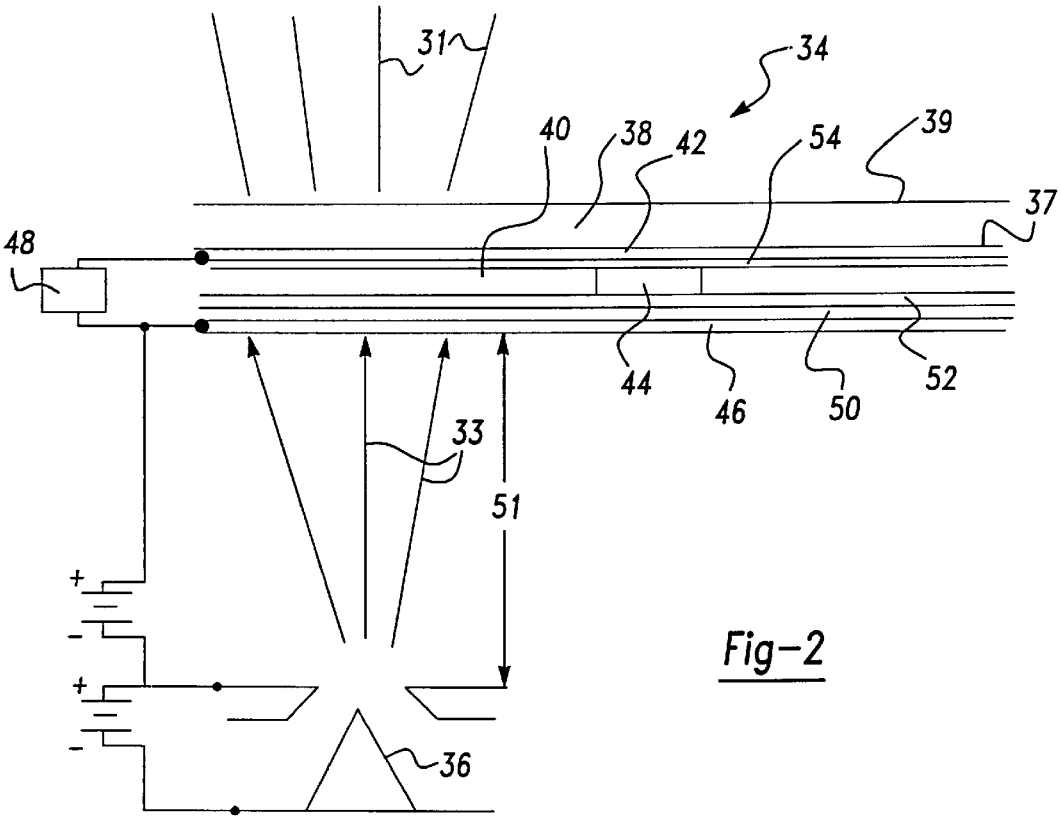
FIG. 2 is a cross sectional schematic view of an exemplary field emission display device implementing the various aspects of the invention.

FIG. 2 schematically illustrates presently preferred embodiments of the invention with features which can be readily adapted to the type of FED device 10 shown in FIG. 1, as well as to other types of field emission display devices with other types of field emitters not illustrated. As shown in FIG. 2, a field emission display (FED) device 34 is depicted with a cathode emitter 36 spaced from a faceplate 38 electrically biased with respect to the cathode emitter 36 via ITO layer 42, and a light emitting layer 40 of cathodoluminescent material for bombardment by electrons 33 resulting from primary emissions of electrons by the cathode emitter 36. While a single emitter 36 is schematically illustrated for a servicing of a single display pixel location, it will be understood that a matrix or multiplicity of cathode emitters may be used, such as was previously described with reference to FIG. 1.

The faceplate 38 is generally transparent to allow transmission of emitted light 31 from an inside surface 37 of faceplate 38 to an outside surface 39 of faceplate 38 for viewing. Electrical biasing of the faceplate 38 is accomplished by using an anode electrode comprising a transparent layer 42 of electrically conductive material, such as indium tin oxide (ITO), disposed between the inside surface 37 of faceplate 38 and the light emitting layer 40. Preferably, the conductive layer 42 will be deposited ITO on the inside surface 37 of the faceplate 38, with a resistance of about 200 to 300 ohms per square, and a refractive index of less than 1.75, to permit at least 80% of directed emitted light to be transmitted through the conductive layer 42 and the faceplate 38. The conductive layer 42 may be continuous or it may be patterned, for example, such as by having addressable strips to implement a full color display as taught in U.S. Pat. No. 5,225,820.

The light emitting layer 40 preferably has a thickness on the order of about 1200 Angstroms, and preferably comprises smooth deposited phosphors that can be applied by atomic layer epitaxy (ALE) or by the vapor reaction technique taught by Cusano and Studer in U.S. Pat. No. 2,685,530. Phosphors such as $Y^2O^3:Eu^{3+}$ can be used, as can other cathodoluminescent phosphors such as oxide type (e.g., ZnO:Zn) or sulfur-based cathodoluminescent phosphors. The best thickness for a phosphor layer depends upon the conductivity of the phosphors. Generally, phosphor field strengths are preferred to be in excess of $5\times10^4$ volts/centimeter. Because of the high field strengths involved with electron tunneling, use of phosphor powders is not presently preferred. One of the reasons for this is related to the packing density of phosphors. Spherical phosphor particles pack more densely than polyhedral particles and would be the phosphor particle of choice. However, conventional commercially available phosphor powders generally have a polyhedral makeup. Preferably, the light emitting layer 40 will be masked or patterned as dots or otherwise on the faceplate 38 to provide a matrix of discrete pixel areas, with addressing provided via a selective cathode-emitter area activation. FIG. 2 illustrates use of black matrix separations 44, but such use is merely optional and not required.

As shown in FIG. 2, the FED device 34 includes a biasing electrode 46 comprising a layer of electrically conductive material penetrable by emitted electrons and disposed between the cathode emitter 36 and the light emitting layer 40. A biasing voltage source 48 is coupled across the light emitting layer 40 between the faceplate 38 and the biasing electrode 46, via a coupling to the anode electrode, transparent layer 42. Such biasing of the light emitting layer 40 can generally lower the electron energy levels required for high-brightness, cathodoluminescent light emissions, thereby lessening cathode emitter 36 to anode 42 working voltage requirements. Also, smaller gaps or spacings 51 between the cathode emitter 36 and the light emitting layer 40 and lower vacuums can be used within the FED 34. For example, it should be feasible to use an emitter-cathode to phosphor spacing of less than 100 $\mu$m, an internal working vacuum less than $10^5$ Torr, and an emitter-cathode to anode working potential less than 500 volts (for high voltage phosphors), as may be desired.

The biasing voltage source 48 may provide either a DC or an AC potential biasing, to generally lower the electron energy levels required for high-brightness, cathodoluminescent light emissions. DC biasing is presently preferred for low voltage phosphors, while AC biasing is presently preferred for high voltage phosphors (to discharge possible buildup of capacitive charges). Advantageously, the biasing potential can be adjusted or modulated to provide brightness or gray scale control within the display. For example, the level of the bias voltage may be made variable, or the output of the biasing voltage source 48 may be variably pulse width modulated. The general level of the bias voltage will depend upon the nature and quality of the intervening film layers, but should generally be on the order of about 20 to 35 volts. In DC operation, the anode layer 42 is positively charged with respect to layer 46, which is connected to a negative terminal of supply 48.

Preferably, the biasing electrode 46 will be comprised of an amplification material having a high amplification factor, for producing secondary emissions of electrons when bombarded by primary emissions of electrons 33 from the cathode emitter 36. By way of example, the amplification factor for copper-beryllium (e.g., Cu—Be) is estimated to be approximately 4 to 6. This means that when bombarded with electrons of sufficient energy, for each electron reaching the copper-beryllium target, there will be 4 to 6 electrons emitted. (On this scale, the secondary emission amplification factors for most metals are less than two). Silver-magnesium (e.g., Ag—Mg) films are similar to those of copper-beryllium. In the FED device 34 as shown in FIG. 2, primary electrons will bombard and enter the biasing electrode 46 material from the side of the cathode emitter 36, generating secondary electron emissions internally or on the side of the light emitting layer 40. Presently preferred amplification materials include copper-barium, copper-beryllium, gold-barium, silver-magnesium or tungsten-barium-gold. Also, gold-calcium would be a particularly effective amplification material to use, although its amplification properties may not have been heretofore well appreciated.

Secondary emitters in the area of the faceplate 38 may be a problem if the wrong materials are chosen, particularly if ultraviolet (UV) filters are not used to block incoming ambient light. Because of ambient light entering the faceplate 38, if a material with too low of a work function is used, some washout of the screen could occur, resulting in a lower viewing contrast, if ambient light levels are excessive. In the absence of UV filtering, it is accordingly preferred that materials with work functions above 3.3 eV be used. One such material is tungsten-barium-gold (e.g., W—Ba—$Au_5$), which requires a violet light source at 3756 Angstroms for photoelectric emissions. Others are copper-beryllium, with photoelectric emissions at 2950 Angstroms, or copper-barium (e.g., Cu—Ba) or gold-barium (e.g., Au—Ba), both with photoelectric emissions at about 3700 Angstroms. Unless viewing of the screen is in direct sunlight, any of these materials should work quite well without screen contrast problems.

The source of secondary emissions in a material is dependent upon the bombardment energy. For example, in copper-beryllium, at 20 eV, electrons are emitted from a depth of about 60 Angstroms. At energies greater than 50 eV, secondary emissions can be appreciable at depths of about 500 Angstroms.

However, such a depth would require many electrons to travel a larger distance to reach the surface, resulting in a higher probability of collisions enroute and thus a loss of secondary emission energy levels. The thickness of the biasing electrode 46 should in any case be thick enough for conduction, but thin enough for effective electron penetration. When using an amplification material such as copper-beryllium in the illustrated application, a thickness on the order of about 120 Angstroms is presently preferred for the biasing electrode 46.

As illustrated in FIG. 2 and described above, the electrically conductive layer 46 can advantageously serve a dual function as a biasing electrode and as an amplification layer for producing secondary emissions of electrons when bombarded by electrons 33 from the cathode emitter 36. It will be understood, however, that phosphor biasing may be provided without necessarily selecting a high amplification factor material for the biasing electrode 46. Also, while only a single stage of electron multiplication is illustrated, it is further possible to have multiple stages of amplification as found in common photo-multiplier tubes.

To achieve enhanced secondary electron emissions within the FED device 34, particularly for when the biasing electrode 46 is composed of a high amplification factor material, an amplification enhancement layer or film 50 can be disposed between the cathode emitter 36 and the light emitting layer 40. The biasing electrode 46 amplification material will generally be applied directly over top of the amplification enhancement layer 50 as shown. The material for amplification enhancement layer 50 is preferred to consist essentially of an oxide of barium, beryllium, calcium, magnesium or strontium. Preferably, the amplification enhancement layer 50 will be a near mono-molecular layer of magnesium oxide (e.g., in association with an Ag—Mg layer 46) or beryllium oxide (e.g., in association with a Cu—Be layer 46). A calcium oxide layer 50 would be preferred in association with a gold-calcium layer 46. A 120 Angstrom thick copper-beryllium amplification material layer 46 deposited over top (i.e. on the cathode emitter side) of a near mono-molecular layer 50 of magnesium oxide or beryllium oxide will help increase secondary emissions as described herein.

The amplification layer 46 and the amplification layer 50 may be deposited by conventional sputtering from a conditioned alloy target or, for example, by a co-sputtering process. To illustrate, a lightly oxidized beryllium target may be prepared by moving a target from room-temperature, ambient conditions to an oven at about 250° C. for about 30 minutes, converting the exposed beryllium surface to Be—O. The resulting lightly oxidized target can then be introduced along with a second, copper target for use within a sputtering chamber which is evacuated and back-filled with argon to a pressure of approximately one to ten microns. By sputtering initially from the beryllium target only, a near mono-molecular beryllium oxide layer 50 may be deposited. By then co-sputtering from the beryllium and copper targets simultaneously, a copper-beryllium layer 46 can then be deposited to a thickness of 120 Angstroms.

As shown in FIG. 2, the FED device 34 may further incorporate a barrier layer 52 of a thin film of insulator material, preferably silicon nitride, disposed between the emitter-cathodes 36 and the light emitting layer 40. The barrier layer 52 will generally be disposed directly on the cathode side of the light emitting layer 40 as shown. The barrier layer 52 functions to inhibit effects of phosphor sputtering or decomposition within the FED device, and can lessen or help eliminate requirements for emitter-cathode to phosphor spacings 51 and a high working vacuum. Preferably, this is a thin silicon nitride layer 52 applied directly on the light emitting layer 40, thin enough to permit the tunneling of electrons but thick enough to inhibit the flow of ions or scattering of the phosphor materials within the device when the device is activated. It is important to appreciate that silicon nitride is an effective blocker of ions, and that electron tunneling is exhibited in sufficiently thin films of silicon nitride.

As further shown in FIG. 2, the FED device 34 may also incorporate a barrier layer 54 of a thin film of insulator material, preferably silicon nitride, disposed between the anode electrode transparent layer 42 and the light emitting layer 40. The barrier layer 54 will generally be disposed directly on the anode side of the light emitting layer 40 as shown. The barrier layer 54 functions to inhibit ion flow, migrations or depositions of anode material on or into light emitting layer 40. Preferably, this is a thin silicon nitride layer applied directly on the anode electrode transparent layer 42, thin enough permit the tunneling of electrons but thick enough to inhibit the flow of ions by way of anode plating action into the phosphor when the device is activated.

What may not be appreciated is the effect that such plating action may have on phosphor poisoning and lifetime degradations in a field emission display.

A further advantage of each of silicon nitride barrier layers 52 and 54 results from the tunneling characteristics of the nitride material, to enhance the non-linearity and luminous efficiency of the FED device 34. Cathodoluminescent phosphors are generally very efficient under high accelerating voltages as compared to phosphors excited at low accelerating voltages. In fact, luminescence can for the most part disappear when the excitation voltage drops below a "dead voltage", which can be as high as about 1500 volts for high voltage phosphors in conventional devices. This occurs because of a dead surface layer on the phosphors and charge build-up. What is important to realize is that there must be good electron penetration into the phosphor material to achieve good luminous efficiency. When phosphors are excited at low voltages, the current may be high but penetration is low, resulting in poor luminous efficiency.

With one or more silicon nitride barrier layers as illustrated at 52 and 54 in FIG. 2, the phosphor excitation voltage is effectively increased until tunneling occurs and the barrier layers become conductive via tunneling. This increase in excitation voltage-prohibiting current flow until a high field is present-results in higher electron 33 penetration into the light emitting layer 40 and increased phosphor efficiencies. The silicon nitride barrier layers 52 and 54 thus each contribute to high brightness cathodoluminescence with improved light conversion efficiencies and phosphor lifetimes within a field emission display device 34.

Chemical vapor deposition (CVD) and sputtering are two well known and acceptable techniques for the deposition of the silicon nitride barrier layers 52 and 54, which are presently preferred for each to be deposited to a thickness on the order of about 30 to 40 Angstroms. For efficient electron tunneling through the nitride barrier layers 52 and 54, and for voltage drops of less than 10 volts across each silicon nitride layer, their thickness should be less than about 100 Angstroms each. If phosphor biasing is implemented, the bias voltage can be on the order of about 20 to 35 volts with the nitride barrier layers 52 and 54 being within this thickness range. Field strengths across the nitride barrier layers 52 and 54 are preferably on the order of $10^6$ volts/centimeter for effective tunneling of electrons through the films.

While silicon nitride is the presently preferred material for barrier layers 52 and 54, other dielectric materials such as silicon dioxide, magnesium fluoride or polyamide materials (e.g., Kapton™ polyamide films) may also be useable. Also, a semiconductor material, such as amorphous or poly silicon, can be used for the barrier layer 54. Whatever dielectric or insulator material is used it is preferred that the layers 52 and 54 be dense as opposed to porous. Standard thermal evaporated material films usually tend to be porous, while sputtered and CVD films are more dense and therefore preferred.

As described, the features of the FED device 34 will provide for a high-brightness field emission display with improved operating characteristics and durability. The features of phosphor biasing, electron emission amplification, and nitride barrier layers will contribute to the reduction of emitter to phosphor gap and vacuum requirements, while permitting a wider range of operating voltages as may be more efficient or otherwise desirable for improved brightness levels. Contamination control is provided to extend emitter life and ion blocking is further used to extend the phosphor life.

While the presently preferred embodiments of the invention have been illustrated and described, it will be understood that those and yet other embodiments may be within the scope of the following claims.

What is claimed is:

1. A cathodoluminescent field emission display device, which comprises:

a faceplate through which emitted light is transmitted from an inside surface to an outside surface of the faceplate for viewing;

a cathode emitter, for primary field emissions of electrons;

an anode, comprising a layer of electrically conductive material disposed between the inside surface of the faceplate and the cathode emitter;

a light emitter layer of cathodoluminescent material capable of emitting light through the faceplate in response to bombardment by electrons emitted within the device, disposed between the anode and the cathode emitter;

a biasing electrode, comprising a layer of electrically conductive material penetrable by electrons emitted within the device and disposed between the cathode emitter and the light emitter layer;

a biasing voltage source, coupled across the anode and the biasing electrode, for applying a bias voltage across the light emitter layer; and a barrier layer disposed between the light emitter layer and the biasing electrode to inhibit ion flow.

2. A cathodoluminescent field emission display device, which comprises:

a faceplate through which emitted light is transmitted from an inside surface to an outside surface of the faceplate for viewing;

a cathode emitter, for primary field emissions of electrons;

an anode, comprising a layer of electrically conductive material disposed between the inside surface of the faceplate and the cathode emitter;

a light emitter layer of cathodoluminescent material capable of emitting light through the faceplate in response to bombardment by electrons emitted within the device, disposed between the anode and the cathode emitter;

a biasing electrode, comprising a layer of electrically conductive material penetrable by electrons emitted within the device and disposed between the cathode emitter and the light emitter layer;

a biasing voltage source, coupled across the anode and the biasing electrode, for applying a bias voltage across the light emitter layer; and a barrier layer disposed between the light emitter layer and the biasing electrode to inhibit scattering of light emitter layer material within the device.

3. A cathodoluminescent field emission display device, which comprises:

a faceplate through which emitted light is transmitted from an inside surface to an outside surface of the faceplate for viewing;

a cathode emitter, for primary field emissions of electrons;

an anode, comprising a layer of electrically conductive material disposed between the inside surface of the faceplate and the cathode emitter;

a light emitter layer of cathodoluminescent material capable of emitting light through the faceplate in response to bombardment by electrons emitted within the device, disposed between the anode and the cathode emitter;

a biasing electrode, comprising a layer of electrically conductive material penetrable by electrons emitted within the device and capable of producing secondary emissions of electrons when bombarded by electrons within the device and disposed between the cathode emitter and the light emitter layer;

a biasing voltage source, coupled across the anode and the biasing electrode, for applying a bias voltage across the light emitter layer; and a barrier layer disposed between the light emitter layer and the biasing electrode to inhibit ion flow.

4. A cathodoluminescent field emission display device, which comprises:

a faceplate through which emitted light is transmitted from an inside surface to an outside surface of the faceplate for viewing;

a cathode emitter, for primary field emissions of electrons;

an anode, comprising a layer of electrically conductive material disposed between the inside surface of the faceplate and the cathode emitter;

a light emitter layer of cathodoluminescent material capable of emitting light through the faceplate in response to bombardment by electrons emitted within the device, disposed between the anode and the cathode emitter;

a biasing electrode, comprising a layer of electrically conductive material penetrable by electrons emitted within the device and capable of producing secondary emissions of electrons when bombarded by electrons within the device and disposed between the cathode emitter and the light emitter layer;

a biasing voltage source, coupled across the anode and the biasing electrode, for applying a bias voltage across the light emitter layer; and a barrier layer disposed between the light emitter layer and the biasing electrode to inhibit scattering of light emitter layer material within the device.

5. A cathodoluminescent field emission display device, which comprises:

a faceplate through which emitted light is transmitted from an inside surface to an outside surface of the faceplate for viewing;

a cathode emitter, for primary field emissions of electrons;

an anode, comprising a layer of electrically conductive material disposed between the inside surface of the faceplate and the cathode emitter;

a light emitter layer of cathodoluminescent material capable of emitting light through the faceplate in response to bombardment by electrons emitted within the device, disposed between the anode and the cathode emitter;

a biasing electrode, comprising a layer of electrically conductive material penetrable by electrons emitted within the device and disposed between the cathode emitter and the light emitter layer;

a biasing voltage source, coupled across the anode and the biasing electrode, for applying a bias voltage across the light emitter layer;

a barrier layer disposed between the light emitter layer and the biasing electrode to inhibit ion flow and scattering of light emitter layer materials within the device when the device is activated; and an amplification enhancement layer disposed between the biasing electrode and the light emitter layer for enhanced secondary emissions of electrons with the device.

6. A cathodoluminescent field emission display device, which comprises:

a faceplate through which emitted light is transmitted from an inside surface to an outside surface of the faceplate for viewing;

a cathode emitter, for primary field emissions of electrons;

an anode, comprising a layer of electrically conductive material disposed between the inside surface of the faceplate and the cathode emitter;

a light emitter layer of cathodoluminescent material capable of emitting light through the faceplate in response to bombardment by electrons emitted within the device, disposed between the anode and the cathode emitter;

a biasing electrode, comprising a layer of electrically conductive material penetrable by electrons emitted within the device and capable of producing secondary emissions of electrons when bombarded by electrons within the device and disposed between the cathode emitter and the light emitter layer;

a biasing voltage source, coupled across the anode and the biasing electrode, for applying a bias voltage across the light emitter layer;

a barrier layer disposed between the light emitter layer and the biasing electrode to inhibit ion flow and scattering of light emitter layer materials within the device when the device is activated; and an amplification enhancement layer disposed between the biasing electrode and the light emitter layer for enhanced secondary emissions of electrons with the device.

* * * * *